US010385621B2

(12) United States Patent
Cooper

(10) Patent No.: US 10,385,621 B2
(45) Date of Patent: Aug. 20, 2019

(54) DRILL BIT FOR PULLING MATERIAL THROUGH PILOT-CHANNEL

(71) Applicant: Cary Cooper, Winder, GA (US)

(72) Inventor: Cary Cooper, Winder, GA (US)

( * ) Notice: Subject to any disclaimer, the term of this patent is extended or adjusted under 35 U.S.C. 154(b) by 1 day.

(21) Appl. No.: 15/679,399

(22) Filed: Aug. 17, 2017

(65) Prior Publication Data

US 2017/0342777 A1 Nov. 30, 2017

Related U.S. Application Data

(63) Continuation of application No. 14/475,016, filed on Sep. 2, 2014, now Pat. No. 9,771,759, which is a continuation-in-part of application No. 14/207,821, filed on Mar. 13, 2014, now abandoned.

(60) Provisional application No. 61/781,211, filed on Mar. 14, 2013.

(51) Int. Cl.

| | |
|---|---|
| ***E21B 10/36*** | (2006.01) |
| ***E21B 10/40*** | (2006.01) |
| ***E21B 10/38*** | (2006.01) |
| ***E21B 17/04*** | (2006.01) |
| ***E21B 10/60*** | (2006.01) |
| ***E21B 10/61*** | (2006.01) |
| ***E21B 10/26*** | (2006.01) |
| ***E21B 7/06*** | (2006.01) |
| ***E21B 7/28*** | (2006.01) |

(52) U.S. Cl.

CPC ..... *E21B 10/38* (2013.01); *E21B 7/064* (2013.01); *E21B 7/065* (2013.01); *E21B 7/067* (2013.01); *E21B 7/068* (2013.01); *E21B 7/28* (2013.01); *E21B 10/26* (2013.01); *E21B 10/36* (2013.01); *E21B 10/40* (2013.01); *E21B 10/60* (2013.01); *E21B 10/61* (2013.01); *E21B 17/04* (2013.01)

(58) Field of Classification Search

CPC ..... E21B 10/36; E21B 10/40; E21B 10/62; E21B 17/04; B25D 17/005

See application file for complete search history.

(56) References Cited

U.S. PATENT DOCUMENTS 4,923,134 A * 5/1990 Kinnan ..... B65H 75/18 175/103
2012/0118640 A1* 5/2012 Runquist ..... E21B 7/046 175/57

(Continued)

*Primary Examiner* — Cathleen R Hutchins
(74) *Attorney, Agent, or Firm* — Smith Tempel Blaha LLC; Matthew T. Hoots

(57) ABSTRACT

The present disclosure describes various embodiments, as well as features and aspects thereof, of an improved drill bit assembly for a percussion boring system. More specifically, one non-limiting embodiment of an improved drill bit assembly for a percussion boring system comprises a bit and a product engagement member. The bit comprises a slant faced head and at least one exhaust port. The product engagement member comprises a product coupling portion and at least one fluid restriction portion. This improved drill bit assembly is such that, when the product engagement member is detachably engaged with the slant faced head of the bit, a first portion of the fluid stream expelled from the bit is directed substantially forward of the slant faced head and a second portion of the fluid stream is directed substantially rearward from the slant faced head.

17 Claims, 12 Drawing Sheets

(56) References Cited

U.S. PATENT DOCUMENTS

2014/0255103 A1* 9/2014 Crane ..... E21B 7/064
405/184
2014/0367173 A1 12/2014 Cooper

* cited by examiner

DRILL BIT FOR PULLING MATERIAL THROUGH PILOT-CHANNEL

CROSS-REFERENCE TO RELATED APPLICATIONS

This U.S. non-provisional utility patent application is a continuation of U.S. Nonprovisional patent application Ser. No. 14/475,016, filed on Sep. 2, 1014 and bearing the title of DRILL BIT ASSEMBLY FOR DIRECTION PERCUSSION BORING SYSTEM, which is a continuation-in-part of, and claims priority under 35 U.S.C. § 120 to, the U.S. non-provisional utility patent application entitled "SYSTEM AND METHOD FOR HORIZONTAL DIRECTIONAL DRILLING AND PRODUCT PULLING THROUGH A PILOT BORE," filed on Mar. 13, 2014 and assigned application Ser. No. 14/207,821, which claims priority under 35 U.S.C. § 119(e) to, and incorporates by reference the entire contents of, U.S. provisional patent application entitled "SYSTEM AND METHOD FOR HORIZONTAL DIRECTIONAL DRILLING AND PRODUCT PULLING THROUGH A PILOT BORE," filed on Mar. 14, 2013 and assigned application Ser. No. 61/781,211. The entire contents of Ser. Nos. 14/475,016, 14/207,821 and 61/781,211 are hereby incorporated by reference.

BACKGROUND

The present disclosure relates to a percussion boring system and, more particularly, to an improved drill bit assembly for a percussion boring system.

One having ordinary skill in the art knows that percussion boring systems are capable of directionally boring a winding channel in a substrate. These channels are commonly bored for any number of purposes such as for holding a product in the form of a conductive conduit, a fiber optic cable, a stretch of tubing, etc.

Percussion boring a subterranean channel for holding a product usually begins by boring a pilot-channel in a substrate along a substantially predetermined path. The pilot-channel has an entry point, where the leading end of the percussion boring system initially entered the substrate, and an exit point, where the leading end of the percussion boring system eventually emerged from the substrate. Notably, because operators of percussion boring systems are often allowed very little deviation from the approved subterranean path and exit point location, an accurately set-up and calibrated percussion boring system is desirable. Current systems used in the art, however, can be tedious to calibrate during set-up, thereby causing unnecessary delay and cost during set-up and resulting in a less than optimum calibration that makes staying on the predetermined subterranean path difficult. Therefore, there is a need in the art for a percussion boring system that provides for efficient set-up and accurate calibration.

Once emerged from the pilot-bore at the exit point, a percussion boring system may be modified to pull a product back through the bore it just drilled. For percussion boring systems known in the art, modifying the system so that it can pull an attached product back through the bore often entails replacing a drill bit with a back reaming device, i.e. a back reamer. The back reamer may be sized to increase the cross-sectional area of the pilot-bore and condition its walls as the entire drill string is retracted and a product attached to the back reamer is pulled into place. Notably, removing the drill bit and installing the back reamer so that product may be pulled into the bore can be time consuming and expensive to accomplish in the field. Therefore, there is a need in the art for a percussion boring system that may be easily converted from a pilot-boring configuration to a product-pulling configuration without having to remove the drill bit.

SUMMARY

The present disclosure describes various embodiments, as well as features and aspects thereof, of an improved drill bit assembly for a percussion boring system. More specifically, one non-limiting embodiment of an improved drill bit assembly for a percussion boring system comprises a bit and a chuck. The bit comprises a head and a shank. The bit head comprises a slant face. The chuck comprises a first end, a second end and at least thirteen splines. The first end of the chuck comprises a threaded coupling portion for detachably coupling the chuck to a percussion boring system. The second end of the chuck is configured to detachably receive the bit shank such that the shank slidably engages into the at least thirteen splines of the chuck. This improved drill bit assembly is such that when the chuck is fully threaded onto the percussion boring system, and when the bit is detachably received by the chuck, the slant face of the bit is aligned to substantially within a range of 0.00-27.70 arcseconds of an alignment reference point on the surface of the percussion boring system. The alignment reference point may be associated with a bent sub component.

Another non-limiting embodiment of an improved drill bit assembly for a percussion boring system comprises a bit and a product engagement member. The bit comprises a slant faced head and at least one exhaust port. The at least one exhaust port of the bit is configured to expel a fluid stream. The product engagement member comprises a product coupling portion and at least one fluid restriction portion. The product engagement member is configured to detachably engage with the slant faced head of the bit. This improved drill bit assembly is such that, when the product engagement member is detachably engaged with the slant faced head of the bit, a first portion of the fluid stream expelled from the bit is directed substantially forward of the slant faced head and a second portion of the fluid stream is directed substantially rearward from the slant faced head.

Various embodiments, configurations, features and aspects of the improved drill bit assembly for a percussion boring system are described in more detail in the detailed description with reference to the attached drawings.

DETAILED DESCRIPTION OF VARIOUS EMBODIMENTS

Figure 1:
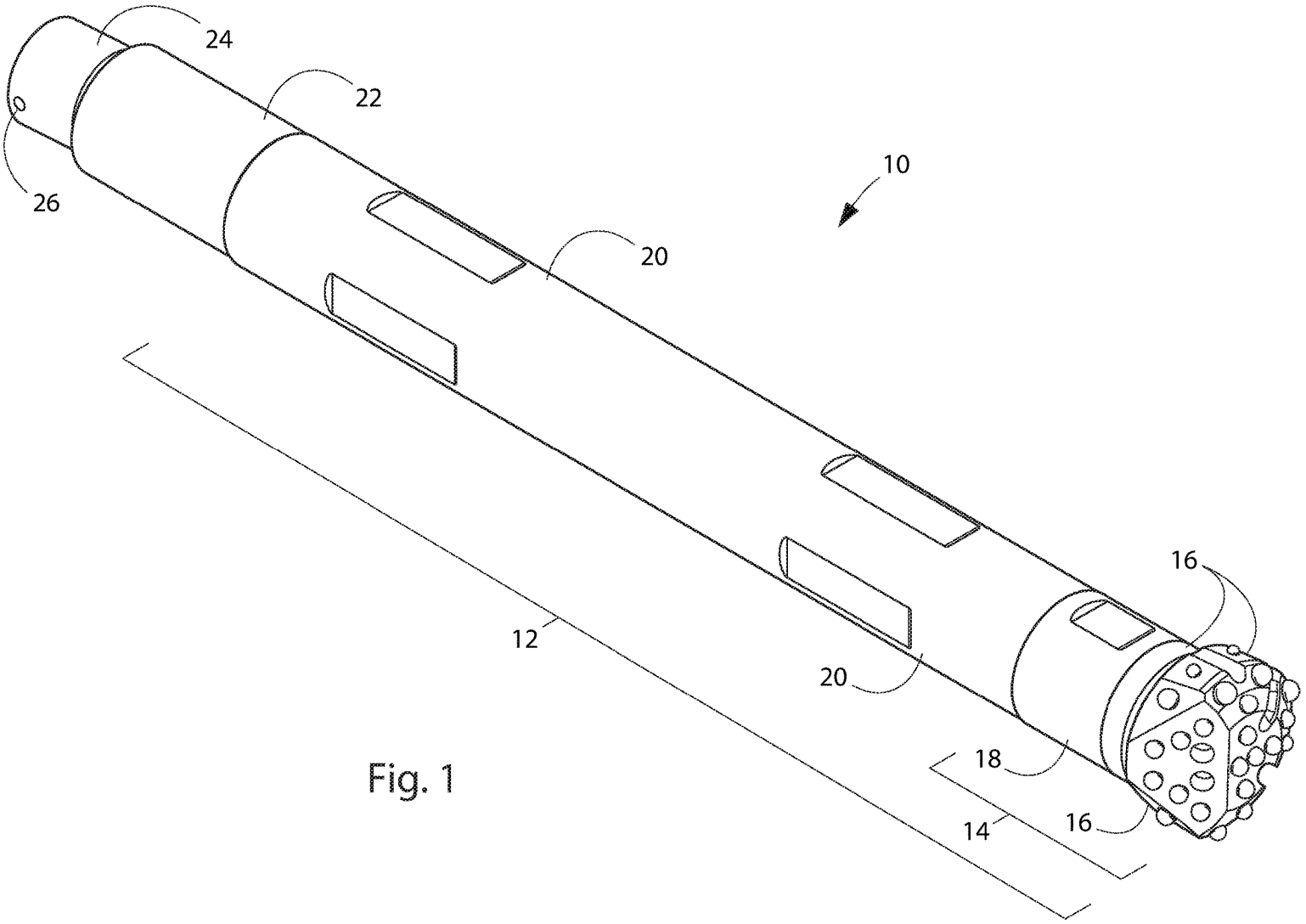
FIG. 1 is a top and side perspective view of one non-limiting embodiment of a leading end of a percussion boring system that includes a bent sub, a sonde assembly and an exemplary slant bit down the hole ("DTH") hammer.

The following written description explains various embodiments of an improved drill bit assembly for a percussion boring system. This written description refers to the appended drawings to supplement the written explanation. As such, the written words should not be construed as limitations. Numerous specific details are explained in the written description and depicted in the drawings to provide an enabling understanding of the various embodiments to one having ordinary skill in the art. Some details, however, need not be expressly explained because they would be readily apparent and understood by one having ordinary skill in the art. For example, certain described embodiments and explanations of some specific details are omitted so as to not unnecessarily obscure the written description. Additionally, one having ordinary skill in the art would understand that the various embodiments might be practiced without some or all of these specific details.

Although throughout the detailed description the various embodiments are directed towards an improved drill bit assembly for a percussion boring system, it should be understood that the focus of such description is only to ensure clarity in the configuration and operation of the various embodiments. The description should not be used to limit the usefulness of the various embodiments in other manners or for other uses.

With the above in mind, the words "exemplary" and "non-limiting" are used herein to mean serving as an example, instance, or illustration. Any aspect described herein as "exemplary" or "non-limiting" is not necessarily to be construed as exclusive, preferred or advantageous over other aspects.

In order to maximize the efficiency and effectiveness of a percussion boring system, which can bore a pilot-channel, pull a product and/or back ream a pilot-channel, embodiments and aspects of the present solution provide a percussion boring system comprising a retrofittable leading end configured to have at least a first pilot-boring configuration and a second product-pulling configuration. When configured according to the pilot-boring configuration, embodiments of the solution may be capable of boring a pilot-channel in a substrate. When configured according to the product-pulling configuration, embodiments of the solution may be capable of product pulling and/or back reaming through a pilot-bore. Notably, embodiments may be converted from a pilot-boring configuration to a product-pulling configuration by the addition of a product engagement member that includes a product coupling portion and, in some embodiments, at least one fluid restriction portion (all features and aspects to be described in greater detail below).

In order to optimize a percussion boring system's efficiency and effectiveness at boring a pilot-channel substantially along a predetermined path, and/or making relatively significant directional adjustments during the boring process, it may be beneficial for a percussion boring system to have aspects for more accurate and precise boring. It may also be beneficial for a percussion boring system to have a user-interface that simplifies set-up and that reduces the number and complexity of user modifications needed throughout the boring process. Therefore, certain embodiments and aspects of the present solution provide a percussion boring system comprising a slant bit and at least thirteen splines. The slant bit may be configured for increased accuracy and adjustment during the pilot-channel boring process, without sacrificing the requisite elements for product pulling and/or back reaming. The at least thirteen splines may provide for the initial alignment of the slant face bit, during setup, to be substantially within an average range of 0.00-27.70 arcseconds of an alignment reference point located on the surface of the percussion boring system (all features and aspects to be described in greater detail below).

As is understood by one having ordinary skill in the art, a percussion boring system comprises a drill string and a leading end. The leading end may be configured to detachably and functionally couple, directly or indirectly, to the drill string. In one non-limiting assembly of a percussion boring system, the leading end comprises a sonde assembly, a bent sub, a hydraulic motor and a drill bit assembly. The sonde assembly may comprise various instrumentations and transmitters for measuring various environmental conditions (e.g., the relative position of the leading end in the substrate, the rotational orientation of the leading end in the channel, and the thermal and pressure conditions in the channel). The sonde assembly may be configured, as is understood by one having ordinary skill in the art, to transmit the measurement data to a percussion boring system operator. The transmitted measurement data may be encoded into an electro-magnetic signal and transmitted, regardless of its encoding form, through the substrate, directly or indirectly, to the percussion boring system operator.

As is understood by one having ordinary skill in the art, the measurement data may be useful for determining whether the drill string should be elongated. The measurement data may also be useful for determining the extension length and, ultimately, the amount of pressure that should be applied to the drill string as it is forced into the substrate. The measurement data may be further useful for determining the rotations per minute of the drill string, for adjusting the rotational orientation of the leading end in the channel, for adjusting the hydraulic pressure of the drilling fluid in the drill string and for controlling the circulation of the drilling fluid in the channel. Ultimately, the measurement data gathered and transmitted by the sonde assembly may also be useful and functional for controlling the relative position of the leading end, in the substrate, and the direction towards which the leading end bores.

Consequently, as is understood by one having ordinary skill in the art, locating the relative position of the leading end in the substrate, via the sonde, and adjusting the rotational orientation of the leading end in the channel, via rotation of the drill string, is an important part of a directional percussion boring process. In one non-limiting variation, a "walk-over" locating system is configured to obtain measurement data from the sonde, and/or locate the leading end through its own sensors. Once the transmitted measurement data is received it may be decoded and/or relayed to the percussion boring system operator.

Related to the above, in one non-limiting variation, the bent sub of the leading end may be bent at an angle relative to the drill string such that the remainder of the leading end, above the bent sub, is also at angle relative to the drill string. The result, as is understood by one having ordinary skill in the art, is a percussion boring system with a leading end that is slightly bent to one direction relative to its associated drill string. The specific bend angle of the bent sub may be application specific. In one non-limiting variation, a bent sub comprises a bend angle range of substantially between 1.0°-3.0° relative to the longitudinal axis of the drill string substantially proximate to the leading end.

In one non-limiting variation, the bent sub and the sonde are situated relative to one another such that locating the sonde, as described above, allows for an inference of the direction, in the channel, towards which the leading end is bent. Consequently, the percussion boring system is configured such that any adjustment of the rotational orientation of the leading end in the channel, via rotation of the drill string, results in a relatively precise adjustment of the direction towards which the "drilling tip" of the leading end is aimed and, ultimately, the direction towards which the leading end bores.

In one non-limiting variation, the hydraulic motor and the drill bit assembly are situated on the bent portion of the leading end (i.e., above the bent sub). As is understood by one having ordinary skill in the art, the hydraulic motor and the drill bit assembly operate in tandem as a down-the-hole percussion hammer (the "DTH hammer"). The DTH hammer is the primary point of engagement between the percussion boring system and the substrate (i.e., the "drilling tip" of the leading end) such that any adjustment in the aim of the drilling tip, ultimately, results in a relatively precise adjustment of the drill bit assembly's boring direction.

As is understood by one having ordinary skill in the art, the drill string transmits the necessary feed force, mechanical rotation, hydraulic pressure, drilling fluid, and/or electromagnetic current to the leading end of the percussion boring system. By leveraging the transmission through the drill string, the hydraulic motor periodically percusses a piston proximate to the drill bit assembly. Advantageously, by the very nature of the hydraulic motor running "down-the-hole," the percussion boring system operates at a higher efficiency because little energy is lost throughout the length of the drill string.

In one non-limiting variation, the drill bit assembly comprises a bit and a chuck. As is understood by one having ordinary skill in the art, the bit comprises a head, a shank and at least one exhaust port. The bit shank comprises an annular strike face (i.e., an anvil), distal to the head, configured to receive, directly or indirectly, the impacts of the hammer-like surface of the hydraulic motor's piston as it percusses. The chuck may comprise a first end, a second end and splines. The first end of the chuck may comprise a threaded coupling portion for detachably coupling the chuck to either the drill string or some other component of the percussion boring system, depending on the specific variation of the percussion boring system. The second end may be configured to detachably receive the shank and hold the bit throughout the boring process. As one having ordinary skill in the art understands, due to the rotation and/or percussive impacts involved in the boring process, the chuck may be configured to detachably receive the shank of the bit such that the shank slidably engages into the splines of the chuck. This ensures the requisite freedom of movement, between the bit and the chuck, for the percussion boring process. The splines may be additionally configured to substantially prevent the rotational movement of the bit when it is engaged with the chuck.

As is understood by one having ordinary skill in the art, the bit engages with the substrate to be bored and works to erode the substrate at the point of engagement during the percussion boring process. The at least one exhaust port of the bit may be configured to expel a fluid, either drilling fluid, compressed air or any other fluid known to one having ordinary skill in the art, such that any eroded substrate at the point of engagement is cleared away from the drill bit assembly. This prevents the drill bit assembly from becoming clogged, which can restrict any necessary freedom of movement between the component parts. This also facilitates the circulation of the drilling fluid in the channel, which cools the moving parts of the leading end. This also facilitates the removal of previously eroded substrate from the channel as the percussion boring process continues.

Drilling fluid may be compressed air, a viscous liquid mixture of water and bentonite, or any other similar combination known to one having ordinary skill in the art. During a boring process, the drilling fluid is typically continuously pumped to the drill bit and expelled from ports in the drill bit. The drilling fluid may be useful for holding eroded substrate particles in suspension and lubricating the bored channel for the drill string and/or the pulled product. Advantageously, these properties of the drilling fluid help stabilize the channel walls, cool the drill bit, alleviate the pressure on the drill bit and prevent a building-up of substrate particles at the drill bit during the boring process.

In some boring systems, the drilling fluid may be recycled throughout the boring process by a reclaimer that circulates the drilling fluid expelled from the drill bit back through the channel and back through the drill string. During this recycling process, the reclaimer may additionally remove the substrate particles from the drilling fluid and regulate/maintain the drilling fluid's ideal viscosity.

"At Least Thirteen Splines" Embodiments

A person having ordinary skill in the art understands that the accuracy and precision of a percussion boring process may not depend solely on aiming the drill bit assembly. The alignment of the various components of the leading end relative to one another during setup, especially those components included in the drill bit assembly, significantly affect the accuracy and precision of the percussion boring process when boring along a predetermined path and/or making relatively significant directional adjustments. This significant effect is magnified when the drill bit is asymmetrical; specifically, when the drill bit comprises a slant face. As is understood by a person having ordinary skill in the art, a slant bit allows for more accurate and precise percussion boring in and of itself.

In one non-limiting variation of a percussion boring system comprising a slant bit, the accuracy and precision of the percussion boring process benefits even more from accurate and precise alignment of the slant face relative to the bent sub and/or sonde. As is understand by one having ordinary skill in the art, the bent sub and the sonde may be situated relative to one another such that locating the sonde allows for an inference of the direction, in the channel, towards which the DTH hammer is aimed (as described above). Because the slant face of the bit adds an extra factor influencing the boring direction of the DTH hammer, any subtle misalignment between the slant face and the bent sub and/or the sonde may have significant affects on the efficiency and effectiveness of the percussion boring process. This is especially true when the percussion boring process requires boring along a relatively long predetermined path and/or making relatively significant directional adjustments.

Even subtle misalignments between the slant face bit and the bent sub may be due to a number of different reasons. First, in variations of the drill bit assembly wherein the chuck comprises a threaded coupling portion (as described above) the machining of the threads on the chuck is rarely consistent from one chuck to another chuck. Therefore, when one chuck replaces a prior chuck, and is fully threaded into position on the percussion boring system (i.e., threaded such that there is no further threading possible and there are no intermediate components between the chuck and the component of the percussion boring system to which it couples), the structural features of the replacement chuck may not align consistent with the previous chuck.

Second, in variations of the drill bit assembly having a chuck that includes splines (as described above), the number of splines of the chuck has a significant affect on the average alignment of a slant bit throughout the percussion boring process. One having ordinary skill in the art understands that the number of splines is directly correlated with the amount of alignment precision possible between the slant face and an alignment reference point on the boring system when the chuck is fully threaded into position at setup.

Therefore, as is understood by one having ordinary skill in the art, a drill bit assembly having a chuck comprising a threaded coupling portion and twelve (12) or fewer splines may require intermediary components, e.g. at least one shim, between the chuck and the component of the percussion boring system to which it couples to correct machining misalignment. As one having ordinary skill in the art understands, correcting this misalignment via shims may be tedious, inexact, difficult and time consuming because determining the number of shims needed may dictate that the drill bit assembly be repeatedly removed, reassembled, replaced and/or measured relative to the alignment reference point.

As such, embodiments and aspects of the present solutions provide for a more accurate initial setup of the drill bit assembly, thereby reducing the potential number of shims required for aligning a slant face drill bit to the bent sub. The slant face bit may comprise a head and a shank. The chuck may comprise a first end, a second end and at least thirteen splines. The first end of the chuck may comprise a threaded coupling portion for detachably coupling the chuck to a percussion boring system. The second end of the chuck may be configured to detachably receive the bit shank such that the shank slidably engages into the at least thirteen splines of the chuck. This improved drill bit assembly is such that when the chuck is fully threaded onto the percussion boring system, and when the bit is detachably received by the chuck, the slant face of the bit is aligned to substantially within an average range of 0.00-27.70 arcseconds of an alignment reference point on the surface of the percussion boring system.

Referring now to the drawings, wherein the showings are for purposes of illustrating the various embodiments of the present solution only and not for purposes of limiting the same, FIG. 1 depicts a top and side perspective view of an exemplary embodiment of a leading end 10 of a percussion boring system that includes a bent sub 24, a sonde assembly 22 and an exemplary slant bit down the hole ("DTH") hammer 12. Exemplary bent sub 24 comprises one non-limiting example of a location for an alignment reference point 26. Exemplary slant bit DTH hammer 12 comprises one non-limiting embodiment of a hydraulic motor 20 and one non-limiting embodiment of a drill bit assembly 14.

It is envisioned that the structural dimensions, curves and contours of leading end 10, including any of its components, may be any length, width and shape known to one having ordinary skill in the art. Furthermore, it is envisioned that leading end 10, including any of its components, may have any number of curves, angles, bends, etc. known to one having ordinary skill in the art. This is true so long as leading end 10, as a whole, is configured to facilitate inference of its relative position in the substrate and the likely direction towards which leading end 10 will bore. Furthermore, as is understood by one having ordinary skill in the art, it is envisioned that an alignment reference point 26 or feature may be situated at any discrete surface point of the percussion boring system.

Figure 2:
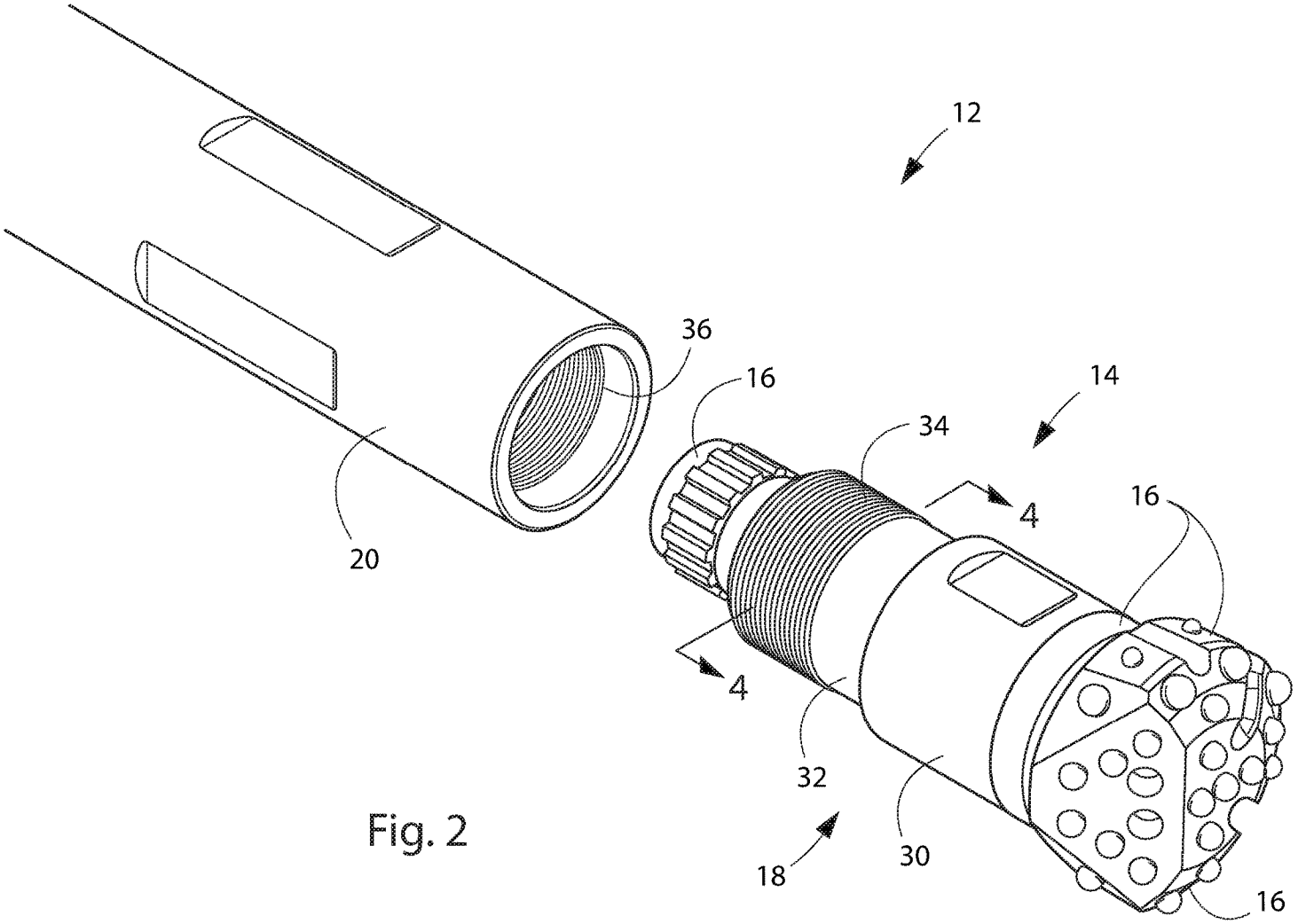
FIG. 2 is an exploded view of the exemplary slant bit DTH hammer of FIG. 1, shown with the drill bit assembly removed from the hydraulic motor.

FIG. 2 is an exploded view of the exemplary slant bit DTH hammer 12 of FIG. 1, shown with the drill bit assembly 14 removed from the hydraulic motor 20. Exemplary hydraulic motor 20 includes a first threaded coupling portion 36. Drill bit assembly 14 comprises one non-limiting embodiment of a chuck 18 and one non-limiting embodiment of a slant faced bit 16. In this particular embodiment of drill bit assembly 14, slant bit 16 extends through chuck 18 and chuck 18 comprises a first end 32 and a second end 30. First end 32 comprises a second threaded coupling portion 34. As can be understood from the FIG. 2 illustration, first threaded coupling portion 36 and second threaded coupling portion 34 are configured to detachably couple drill bit assembly 14 to hydraulic motor 20. Further, second end 30 of chuck 18 is configured to detachably receive slant bit 16. Because slant bit 16 extends through chuck 18, and because drill bit assembly 14 periodically percusses during the percussion boring process, it is envisioned that second end 30 may be configured to structurally withstand the impacts inherent to period percussion and the freedom of movement between chuck 18 and bit 16 for the percussion boring process.

Figure 3:
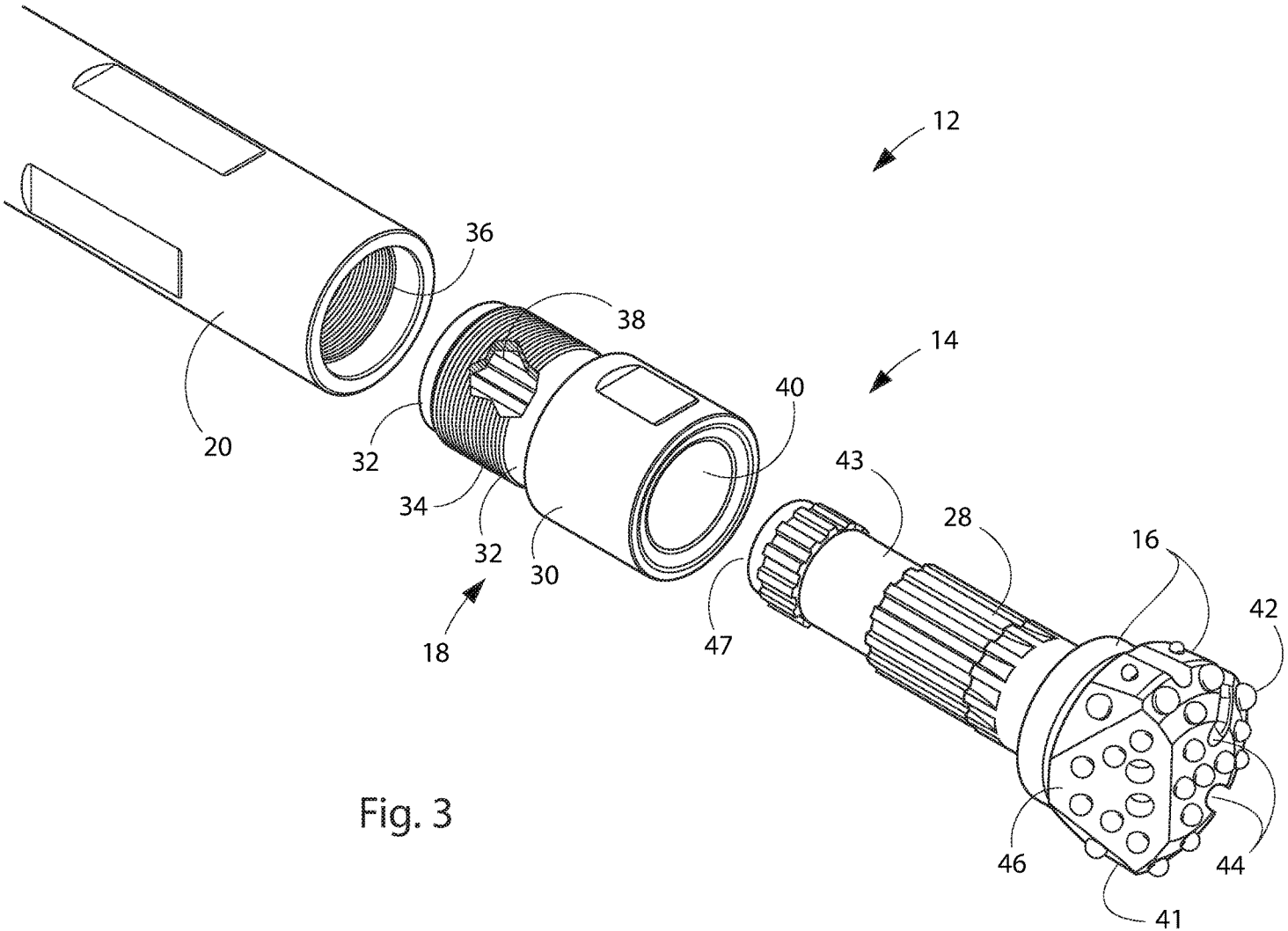
FIG. 3 is an exploded view of the exemplary slant bit DTH hammer of FIGS. 1-2, shown with the drill bit removed from the chuck and the chuck removed from the hydraulic motor.

FIG. 3 is an exploded view of the exemplary slant bit DTH hammer 12 of FIGS. 1-2, shown with the drill bit 16 removed from the chuck 18 and the chuck 18 removed from the hydraulic motor 20. Exemplary bit 16 includes one non-limiting embodiment of a head 41, one non-limiting embodiment of a slant face 46, one non-limiting embodiment a shank 43, one non-limiting embodiment of exhaust ports 44 and one non-limiting embodiment of splines 28. In this one non-limiting embodiment of bit 16, slant face 46 and exhaust ports 44 are situated on head 41. Moreover, shank 43 extends longitudinally from head 41 and comprises one non-limiting embodiment of an anvil 47 situated at the end of shank 43 distal to head 41. Moreover, thirteen splines 28 are situated along the longitudinal length of shank 43. Chuck 18 additionally comprises at least thirteen splines 38 (as depicted in the cut-out) and an inner surface 40. In this particular embodiment, at least thirteen splines 38 are situated entirely on inner surface 40 of first end 32 of chuck 18. Notably, although the exemplary embodiment depicted in the figures is shown with thirteen splines on the inner surface of the chuck and thirteen complimentary splines on the outer surface of the bit shank, it is envisioned that other embodiments may have thirteen or more splines on the chuck and less than thirteen complimentary splines on the bit shank (and/or vice versa).

Furthermore, it is envisioned that slant face 46 situated on head 41 may be made up of one slanted face or multiple slanted faces. Moreover, it is envisioned that the structural dimensions, curves, contours and shape of slant face 46 may be any length, width, depth and angle known to one having ordinary skill in the art. Moreover, it is envisioned that slant face 46 may have numerous other variations, configurations and permutations known to one having ordinary skill in the art. This is true so long as slant face 46, regardless of the specific embodiment, is configured to, at least in part, facilitate the erosion of the substrate by drill bit assembly 14 and to provide increased accuracy and precision for the directional control of the percussion boring process, as is understood by one having ordinary skill in the art.

Furthermore, it is envisioned that exhaust ports 44 situated on head 41 may be any type of channel, aperture, opening, conduit, etc. defined by bit 16. Moreover, it is envisioned that exhaust ports 44 may be situated along any portion of bit 16, including shank 43. This is true so long as exhaust ports 44 are configured to expel a fluid stream (as described above) substantially forward of head 41 such that any eroded substrate at the point of engagement between bit 16 and the substrate to be bored is cleared away from drill bit assembly 14 during the percussion boring process.

Furthermore, and as would be understood by one having ordinary skill in the art, it is envisioned that in this embodiment head 41 is configured to engage with second end 30 of chuck 18 during the percussion boring process. Because exemplary bit 16 extends through chuck 18 in this embodiment, and because bit 16 periodically percusses during the percussion boring process while remaining slidably engaged with chuck 18, it is envisioned that head 41 is further configured to structurally withstand the percussion and impacts inherent to the freedom of movement between chuck 18 and bit 16 for the percussion boring process. As is understood by one having ordinary skill in the art, it may not be necessary for head 41 to engage with second end 30 of chuck 18.

Furthermore, it is envisioned that splines 28 situated along the longitudinal length of shank 43 may have any structural dimensions, curves, contours, shapes, lengths, widths and depths known to one having ordinary skill in the art. Moreover, it is envisioned that splines 28 may be situated running along at least a portion of head 41 or any other component of bit 16. This is true so long as splines 28, regardless of the specific embodiment, are configured to, at least in part, facilitate shank 43 slidably engaging with splines 38 of chuck 18, and substantially prevent the rotational movement of bit 16 in chuck 18 during the percussion boring process, as would be understood by one having ordinary skill in the art.

Figure 4:
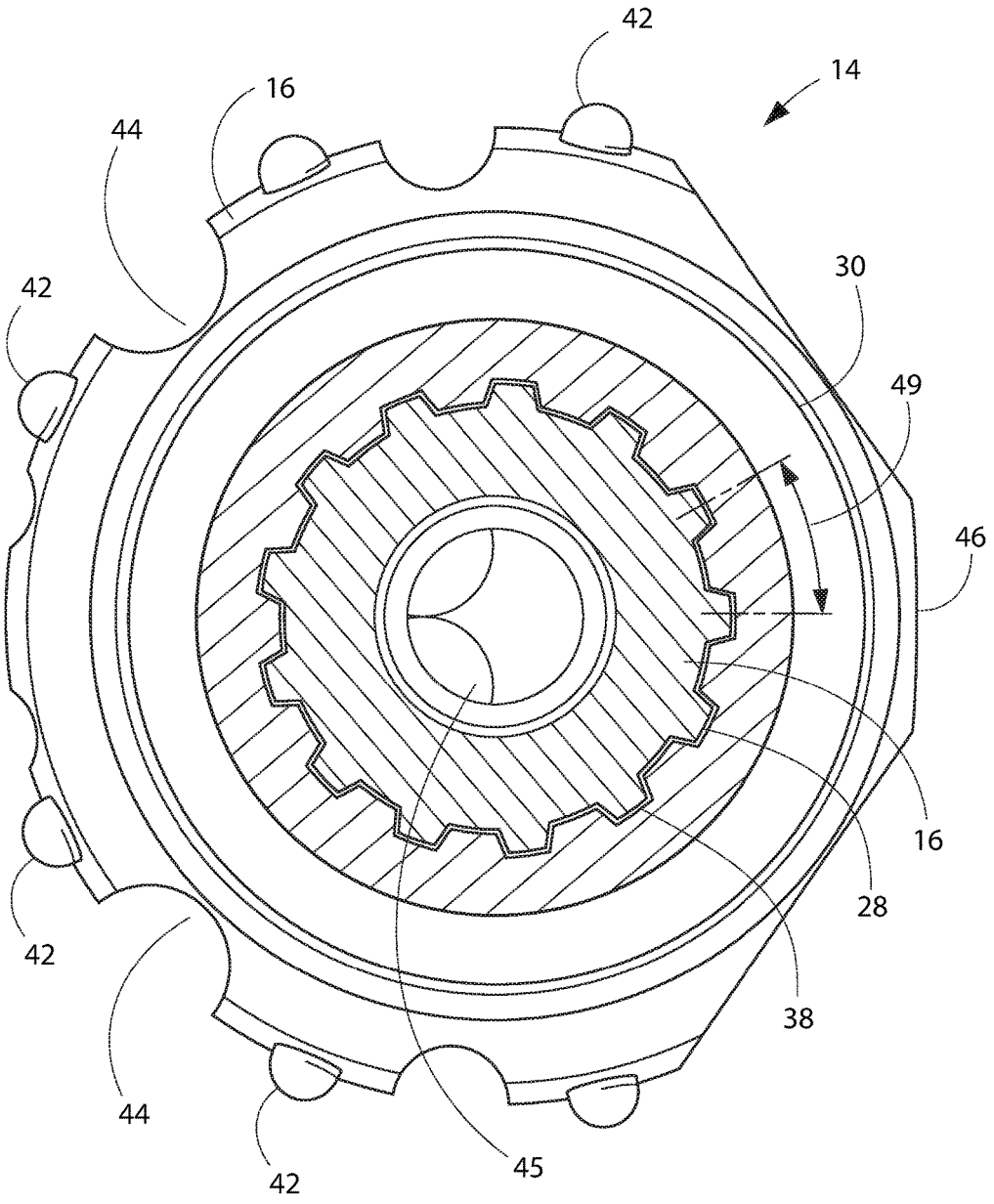
FIG. 4 is a cross-sectional view of the drill bit assembly of FIG. 2.

FIG. 4 is a cross-sectional view of the drill bit assembly 14 of FIG. 2. As can be seen in FIG. 2, bit 16 extends through chuck 18; specifically, shank 43 extends through second end 30 and first end 32 of chuck 18. The cross section depicted in FIG. 4 is of first end 32 and of shank 43. Visible within the cross-section are thirteen splines 38 of chuck 18, thirteen complimentary splines 28 of bit 16 and one non-limiting embodiment of a fluid conduit 45 of bit 16. Additionally, visible around and behind the cross-section are second threaded coupling portion 34 of first end 32, the surface of second end 30, the surface of head 41 of bit 16 and exhaust ports 44 of bit 16.

As depicted in the cutout of FIG. 3, thirteen splines 38 are situated on first end 32 of chuck 18. Thirteen splines 38 define inner surface 40 of first end 32 (visible in FIG. 4 as engaged with splines 28 on shank 43 of bit 16) and having at most 27.70 arcseconds between each spline (depicted as element 49). It is envisioned that splines 38 may have any structural dimensions, curves, contours, shapes, lengths, widths and depths known to one having ordinary skill in the art. Moreover, it is envisioned that splines 38 may extend along at least a portion of inner surface 40 of chuck 18. Splines 38, regardless of the specific embodiment, may be configured to, at least in part, facilitate chuck 18 slidably engaging with splines 28 of bit 16, and substantially prevent the rotational movement of bit 16 in chuck 18 during the percussion boring process, as would be understood by one having ordinary skill in the art. Notably, when chuck 18 is fully threaded onto hydraulic motor 20 (or any other component of leading end 10, as described above), and when splines 28 of bit 16 are slideably engaged with splines 38, slant face 46 of bit 16 may be aligned to substantially within an average range of 0.00-27.70 arcseconds of alignment reference point 26 associated with bent sub 24.

Furthermore, it is envisioned that fluid conduit 45 may run substantially along the longitudinal axis of bit 16 and may have any structural dimensions, curves, contours, shapes, lengths, widths and depths known to one having ordinary skill in the art. Fluid conduit 45 may be one or multiple conduits on bit 16 operable to hold and guide drilling fluid or compressed air to exhaust ports 44 of bit 16.

Figure 5:
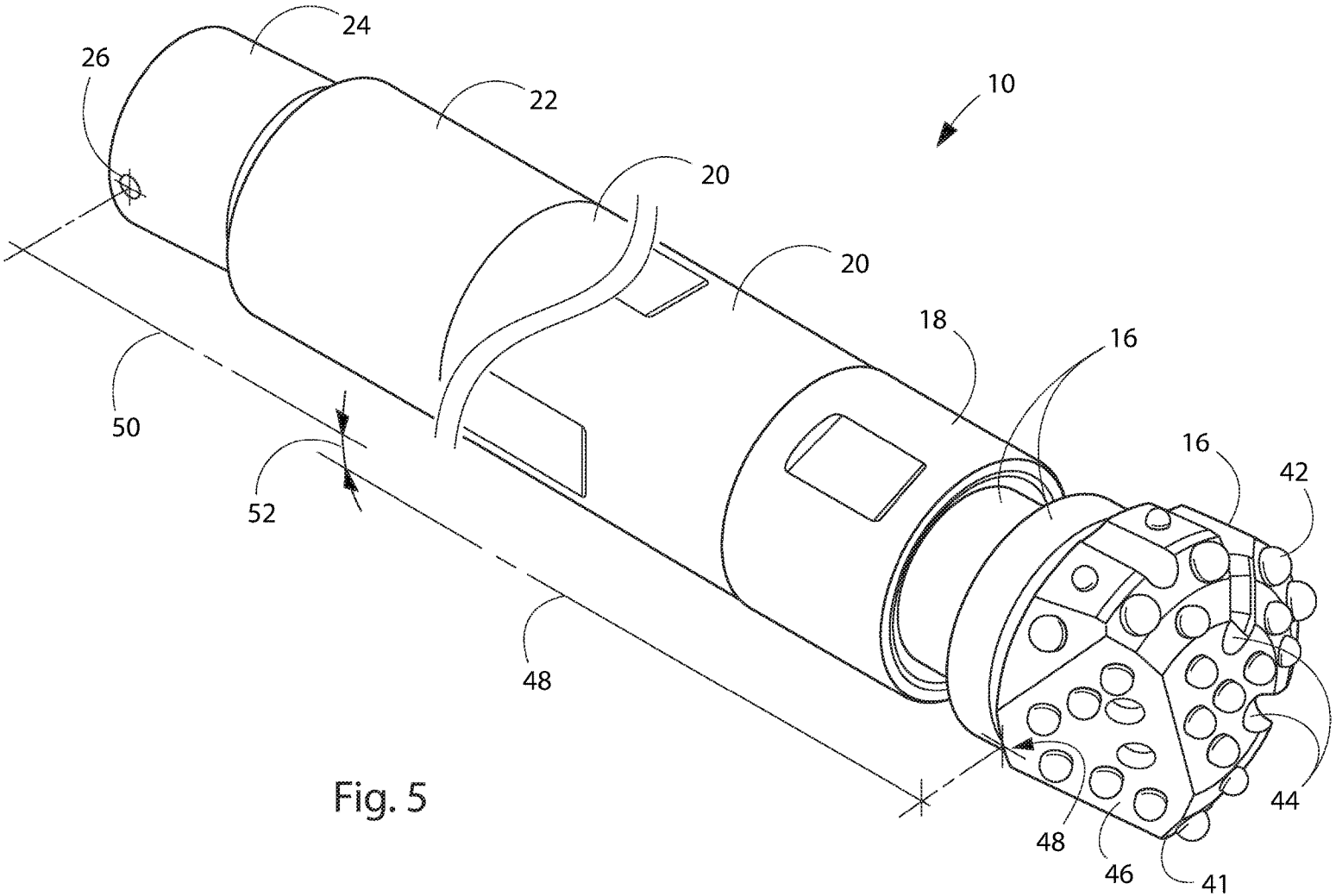
FIG. 5 is a perspective view of the exemplary leading end of FIG. 1, shown fully assembled and misaligned.
Figure 6:
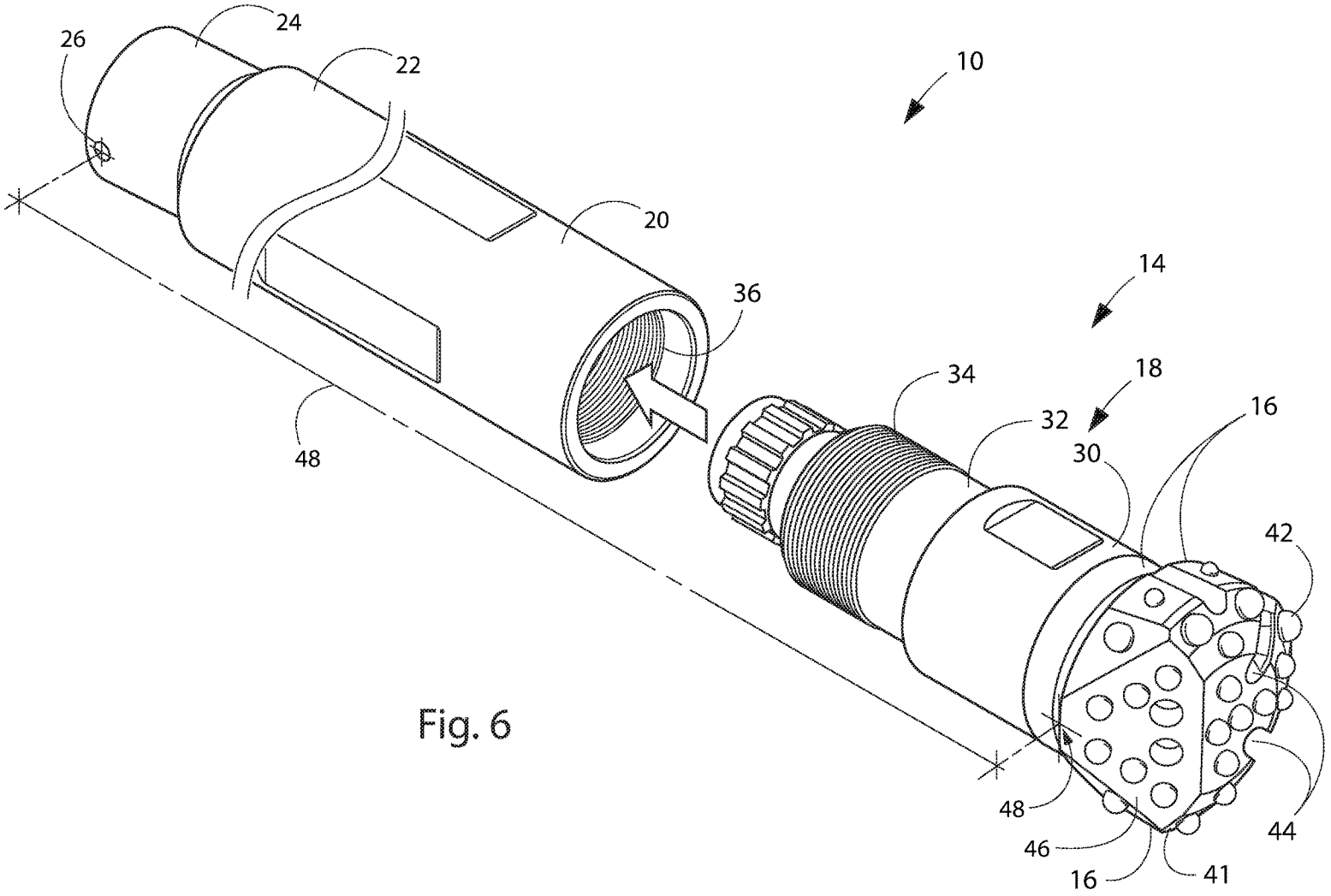
FIG. 6 is an exploded view of the leading end of FIG. 1, illustrating correction of the misalignment shown in FIG. 5.
Figure 7:
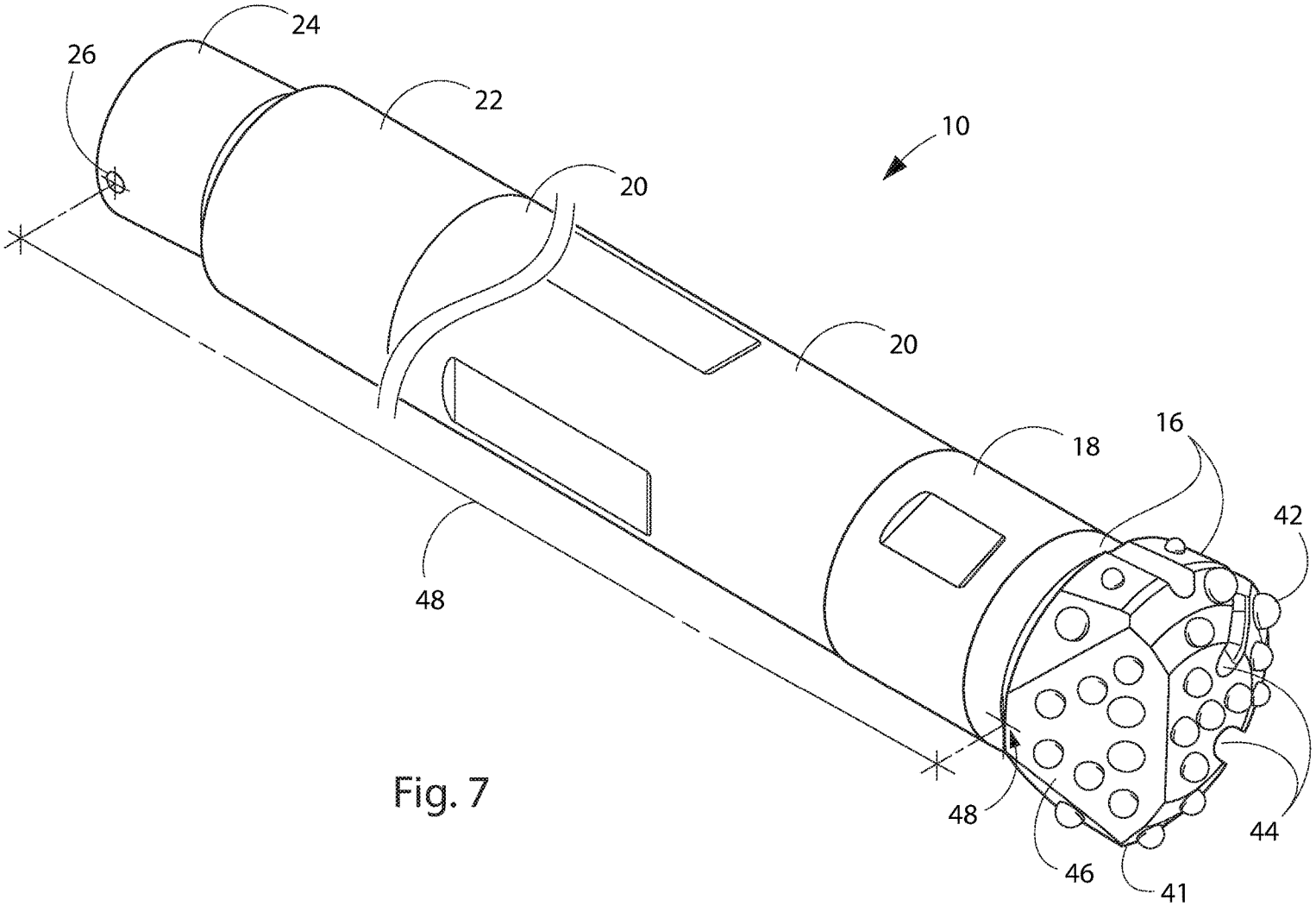
FIG. 7 is a perspective view of the exemplary leading end of FIG. 1, shown reassembled after correction of the misalignment shown in FIG. 5.

FIGS. 5-7 visually depict how the features and aspects of leading end 10, at least in part, may optimize the amount of set-up time needed and simplify the set-up process for alignment of drill bit assembly 14 of slant bit DTH hammer 12 such that slant face 46 of bit 16 is aligned to substantially within an average range of 0.00-27.70 arcseconds of alignment reference point 26 of bent sub 24.

FIG. 5 is a perspective view of the exemplary leading end 10 of FIG. 1, shown fully assembled and misaligned. As can be seen in the FIG. 5 illustration, drill bit assembly 14, via chuck 18, is fully threaded onto hydraulic motor 20 and splines 28 of bit 16 are slideably engaged with splines 38 of chuck 18. However, due to the relative engagement of splines 28 with splines 38 of full assembly drill bit assembly 14, the geometric center, symmetric center, and/or functional center of slant face 46 of bit 16 (shown as element 48) is not aligned to alignment reference point 26 of bent sub 24 when drill bit assembly 14 is fully threaded to hydraulic motor 20. This misalignment is depicted as element 52, which represents the misalignment of the extension line of element 48 and the extension line 50 of alignment reference point 26. Notably, because in the exemplary embodiment splines 28 and splines 38 number thirteen each, the amount of misalignment 52 may be in the range of 0.00-27.70 arcseconds.

Advantageously, whenever element 52 equals a misalignment of substantially 13.850 arcseconds or greater, the misalignment may be reduced or eliminated by disengaging drill bit assembly 14 from hydraulic motor 20 and adjusting the relative orientation of splines 28 with splines 38 by one increment. For the exemplary embodiment depicted in the FIG. 5, however, the misalignment represented by element 52 may be viewed as 27.70 arcseconds.

FIG. 6 is an exploded view of the leading end 10 of FIG. 1, illustrating correction of the misalignment 52 shown in FIG. 5. As described above, drill bit assembly 14 is configured such that drill bit 16 may be disengaged from chuck 18. Once drill bit 16 is disengaged from chuck 18, chuck 18 and drill bit 16 are configured such that the relative orientation of splines 28 with splines 38 may be adjusted via a clockwise or counter-clock wise rotation, by increments of approximately 27.70 arcseconds (rotation not depicted in FIG. 6). Notably, incrementing splines 28 relative to splines 38, and then slidably re-engaging the chuck 18 with bit 16, results in a new relative orientation of splines 28 with splines 38. With this new relative orientation, splines 28 may be slideably engaged with splines 38 such that drill bit assembly 14 is reassembled and ready to be fully threaded-on to hydraulic motor 20.

One having ordinary skill in the art understands that whenever element 52 equals a misalignment of substantially 13.850 arcsecond or greater (i.e., half or more of the 0.00-27.70 arcsecond range), and whenever the relative orientation of splines 28 with splines 38 is adjusted as described above and fully thread-on to hydraulic motor 20, the resulting alignment between element 48 of slant face 46 of bit 16 and alignment reference point 26 of bent sub 24 will be less than 13.850 arcseconds. In the exemplary embodiment depicted in FIGS. 5 and 6 which illustrated an initial setup misalignment of 27.70 arcseconds, the new relative orientation of splines 28 with splines 38 after increment has substantially eliminated the element 52 misalignment. Advantageously, because the misalignment depicted in FIG. 5 was substantially eliminated by increment of splines 28 relative to splines 38, the calibration of slant face bit 16 relative to the bent sub 24 did not necessitate the use of shims between chuck 18 and motor 20.

FIG. 7 is a perspective view of the exemplary leading end 10 of FIG. 1, shown reassembled after correction of the misalignment shown in FIG. 5. The FIG. 7 illustration depicts drill bit assembly 14 reassembled with chuck 18 fully threaded onto hydraulic motor 20 such that the geometric center, symmetric center, and/or functional center of slant face 46 of bit 16 is aligned to substantially within an average range of 0.00-27.70 arcseconds of alignment reference point 26 of bent sub 24 throughout the percussion boring process.

Therefore, as is understood by one having ordinary skill in the art, leading end 10 requires no shims, or other equivalent intermediary components, between hydraulic motor 20 and chuck 18 to correct the misalignment 52 of FIG. 5 when the misalignment 52 is substantially 27.70 arcsecond. Moreover, and as one of ordinary skill in the art would recognize, embodiments of the solution may require less shims than systems known in the art in order to adjust for misalignment as the worst case misalignment scenario between the bit and the bent sub is substantially equal to or less than 27.70 arcseconds. As one having ordinary skill in the art understands, obtaining an alignment resolution of substantially within an average range of 0.00-27.70 arcseconds of alignment reference point 26 of bent sub 24 throughout the percussion boring process makes setup and use of leading end 10 of the percussion boring system less tedious, less difficult and less time consuming.

"Product Puller" Embodiments"

Certain embodiments and aspects of the present solution provide a percussion boring system comprising a slant face bit and a product engagement member. The bit comprises a slant faced head and at least one exhaust port for expelling a fluid stream. The product engagement member comprises a product coupling portion and at least one fluid restriction and redirecting portion. The product engagement member may be configured to detachably engage with the slant faced head of the bit. This improved drill bit assembly is such that, when the product engagement member is detachably engaged with the slant faced head of the bit, a first portion of the fluid stream expelled from the bit is directed substantially forward of the slant faced head and a second portion of the fluid stream is directed substantially rearward from the slant faced head. The result being a multifunctional, more simple-to-operate, more easily convertible and more durable percussion boring system than those known in the art.

Figure 8:
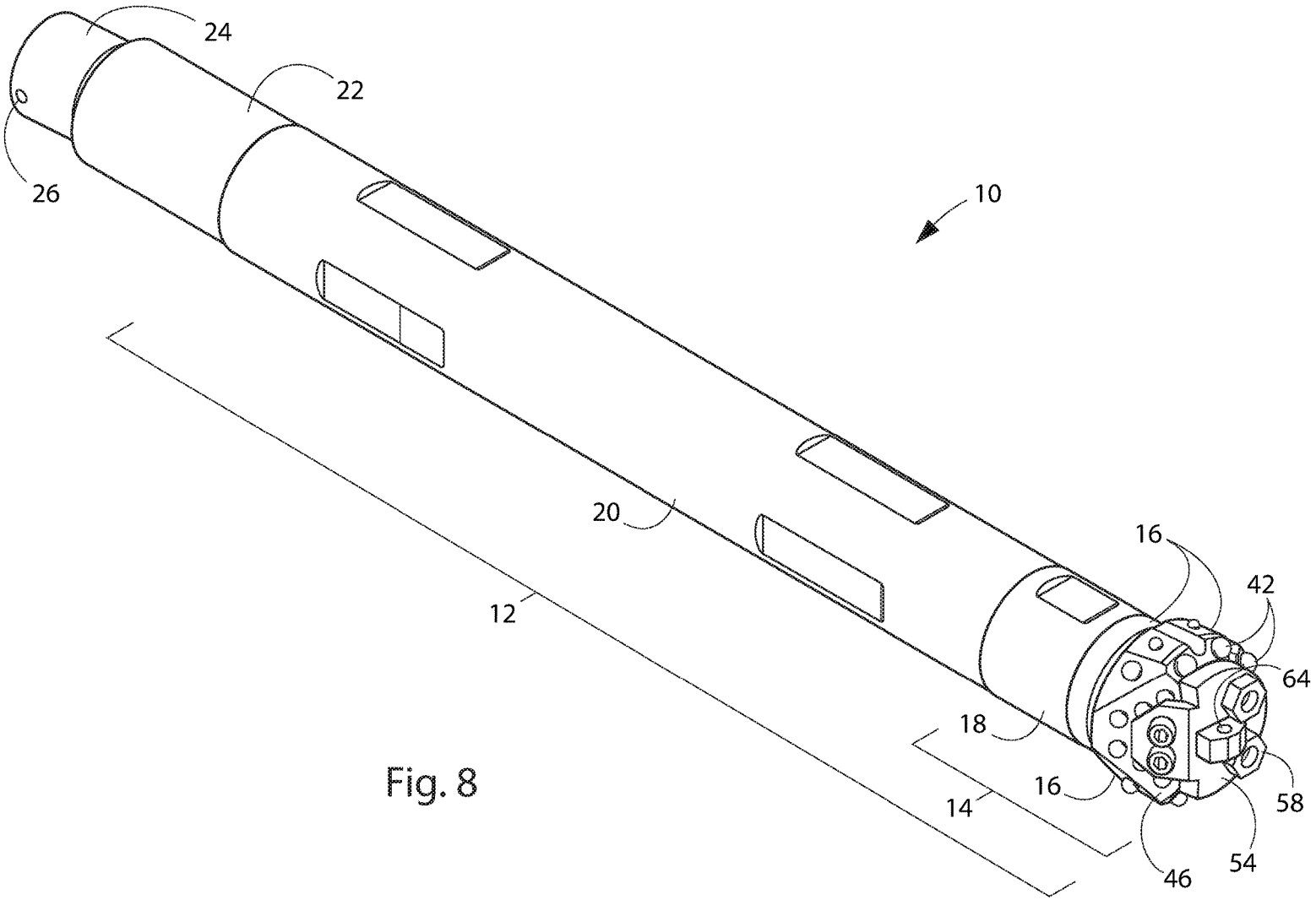
FIG. 8 is a perspective view of an exemplary leading end of a percussion boring system that includes a bent sub, a sonde assembly and an exemplary slant bit down the hole ("DTH") hammer with a product engagement member.

Referring to FIG. 8, depicted is a perspective view of an exemplary leading end 10 of a percussion boring system that includes a bent sub 24, a sonde assembly 22 and an exemplary slant bit down the hole ("DTH") hammer assembly 12 with a product engagement member 54. Product engagement member 54 comprises a pair of exemplary fluid restriction portions 58 and an exemplary product coupling portion 64. In this particular embodiment of leading end 10, product engagement member 54 is detachably coupled to head 41 of bit 16, by any means known to one having ordinary skill in the art, such that at least a portion of product engagement member 54 covers at least a portion of slant face 46 of bit 16 and at least one exhaust port 44 of bit 16. Moreover, the fluid restriction portions 58 of product engagement member 54 are aligned with exhaust ports 44.

Advantageously, in this non-limiting embodiment of product engagement member 54, product engagement member 54 is configured to divert, substantially rearward from head 41 of bit 16, at least a portion of the expelled fluid stream from exhaust ports 44 of bit 16 during the percussion boring process. Product engagement member 54 may be configured to divert the expelled fluid stream by a combination of the fluid restriction portions 58, the surface contours of head 41 and/or the surface contours of product engagement member 54 (specifically, the surface contours of product engagement member 54 along the surface that engages with head 41 when product engagement member 54 is detachably coupled to bit 16).

Figure 9:
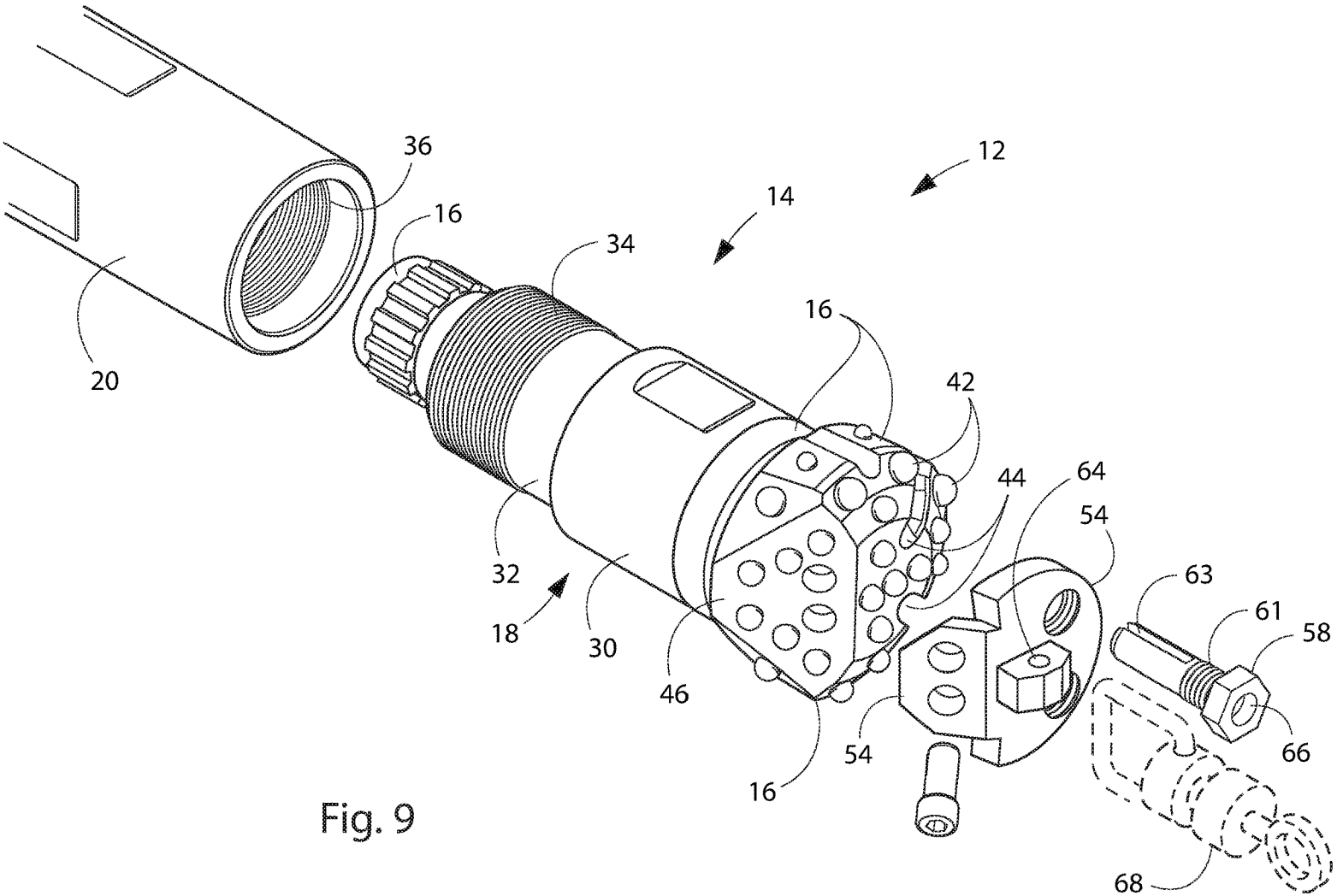
FIG. 9 is an exploded view of the exemplary slant bit DTH hammer of FIG. 8, shown with a chuck and drill bit assembly removed from a hydraulic motor and the product engagement member removed from the drill bit.

FIG. 9 is an exploded view of the exemplary slant bit DTH hammer 12 of FIG. 8, shown with a chuck and drill bit assembly 14 removed from a hydraulic motor 20 and the product engagement member 54 removed from the drill bit 16. In this non-limiting embodiment, exemplary fluid restriction portions 58 may be in the form of a bolt or pin configured to extend into an exhaust port 44 of bit 16. An exemplary fluid restriction portion 58 may include a coupling portion 61 with a groove 63 and a fluid channel 66. The groove 63 and fluid channel 66 may be sized to divert at least a portion of the expelled fluid stream substantially rearward from head 41 of bit 16 during the percussion boring process.

As can further be seen in the figure, coupling portion 61 may be a threaded coupling portion configured to facilitate detachably coupling product engagement member 54 to bit 16. It is envisioned that exhaust port 44 of bit 16 may also comprise a corresponding threaded coupling portion for receiving coupling portion 61. Moreover, it is envisioned that coupling portion 61 and any coupling portion of an exhaust port 44 may be "female," "male" of any other variation/combination known to one having ordinary skill in the art. However, neither coupling portion 61 nor exhaust port 44 is limited to a threaded type of coupling portion nor does fluid restriction portion 58 require a coupling portion 61 in all embodiments of the solution.

Furthermore, groove 63 may be situated along the surface of a fluid restriction portion 58, extending from the bottom of coupling portion 61 throughout the remaining length of fluid restriction portion 58. It is envisioned that a groove 63 or its equivalent, if present in a fluid restriction portion 58, may have any structural dimensions, curves, contours, shapes, lengths, widths and depths that may be required for managing flow of fluid from exhaust port 44. Similarly, fluid channel 66 may extend throughout the entire central length of a fluid restriction portion 58. It is envisioned that fluid channel 66 or its equivalent, if present in a fluid restriction portion 58, may have any structural dimensions, curves, contours, shapes, lengths, widths and depths that may be required for managing fluid flow from exhaust port 44.

Product coupling portion 64 is depicted in the form of a pulling eye with a swivel component (represented by element 68) for detachably coupling a product to be pulled by the percussion boring system. As is known by one having ordinary skill in the art, the swivel prevents the product from rotating with the drill string during the percussion boring process.

Figure 10:
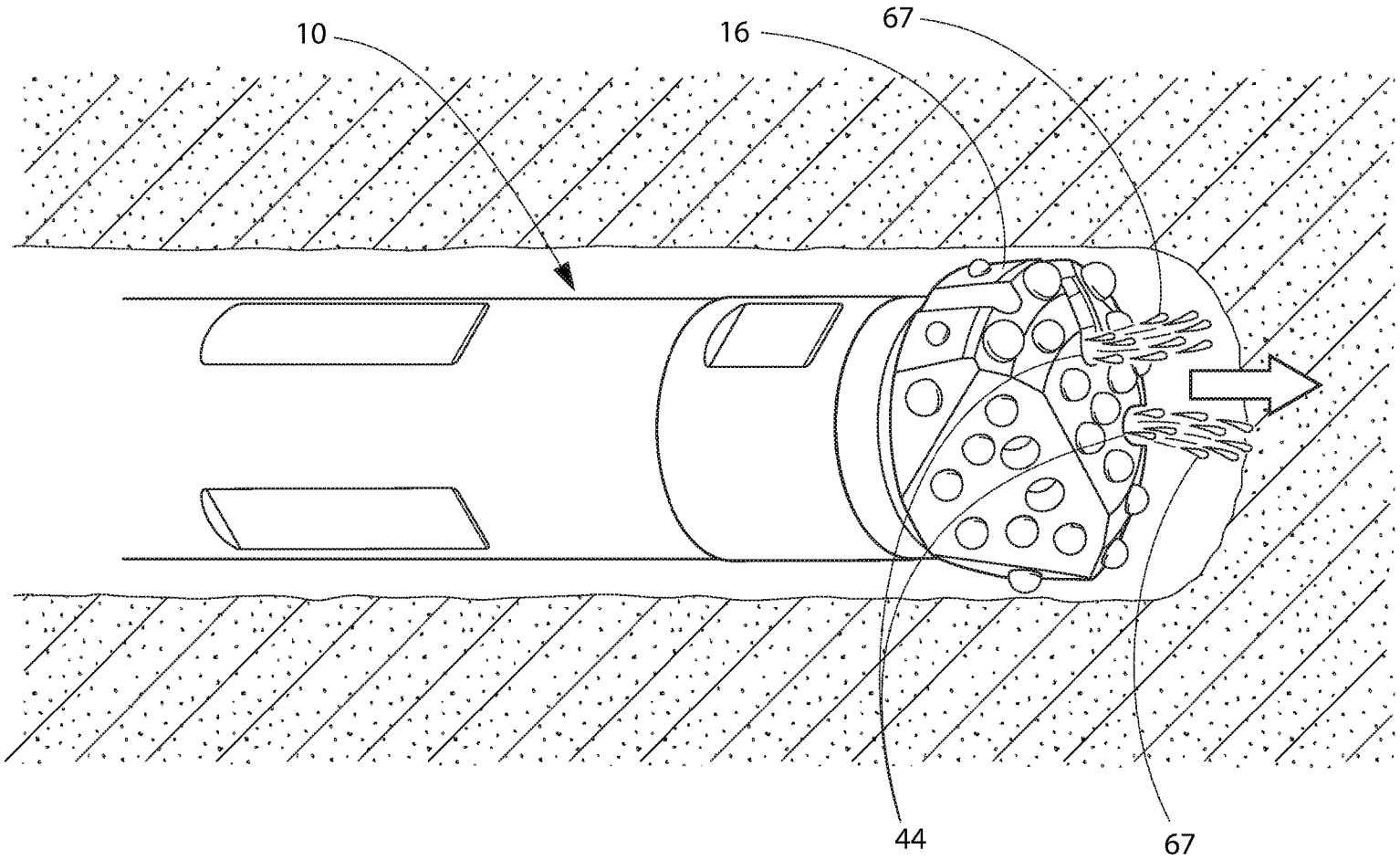
FIG. 10 illustrates the exemplary slant bit DTH hammer of FIG. 1 as it percussion bores a pilot-channel in a substrate.

FIG. 10 illustrates the exemplary slant bit DTH hammer 12 of FIG. 1 as it percussion bores a pilot-channel in a substrate. As can be seen in the FIG. 10 illustration, a fully assembled and aligned leading end 10 is depicted as it percussion bores a pilot-channel in a substrate. As is described above, during the percussion boring process, hydraulic motor 20 periodically percusses an internal component that strikes anvil 47 of shank 43 of bit 16. Anvil 47, being configured to periodically receive these percussive strikes, transfers the impact force to shank 43, which launches bit 16 forward relative to hydraulic motor 20. However, because chuck 18 is configured to hold bit 16, and because splines 28 of shank 43 and splines 38 of chuck 18 are configured to slidably engage with one another, and because leading end 10 is continually forced up against the substrate during the pilot-channel boring portion of the percussion boring process, the impacts between hydraulic motor 20 and anvil 47 continuously repeat. This results in bit 16 periodically engaging with the substrate to be bored such that the substrate is eroded, at least in part, by the periodic percussion of drill bit assembly 14 at the point of engagement, as would be understood by one of ordinary skill in the art.

Furthermore, the substrate is additionally eroded because of the expelled fluid (depicted as element 67) from exhaust ports 44 of bit 16 during the percussion boring process. Because fluid conduit 45 of bit 16 is configured to guide pressurized drilling fluid from hydraulic motor 20 to exhaust ports 44, and because exhaust ports 44 may be configured to expel this pressurized fluid in a stream substantially forward of head 41 of bit 16, the substrate at the point of engagement is, at least in part, eroded by the pressurized fluid stream. Of course, the pressurized fluid steam has other beneficial effects for the percussion boring process (as described above).

As is described above, upon completion of the pilot-channel, the percussion boring system extends from the entry point, where the leading end of the percussion boring system entered the substrate, to the exit point, where leading end 10 emerged from the substrate. The drill string of the percussion boring system remains in the pilot-channel and extends between the entry point and the exit point, as would be understood by one of ordinary skill in the art.

Figure 11:
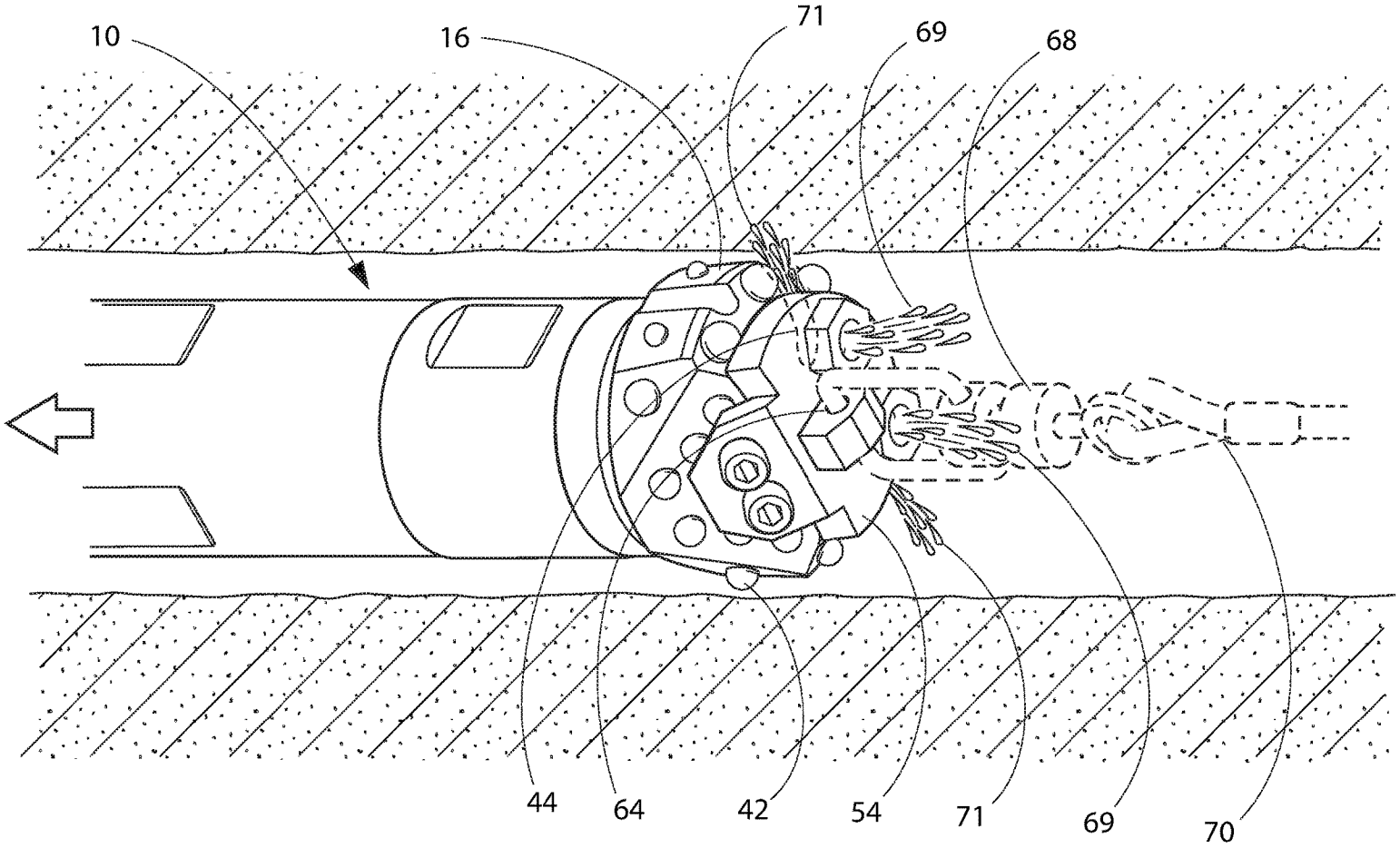
FIG. 11 illustrates the exemplary slant bit DTH hammer and product engagement member of FIG. 8 as it is being retracted through a pilot-channel to pull a product.
Figure 12:
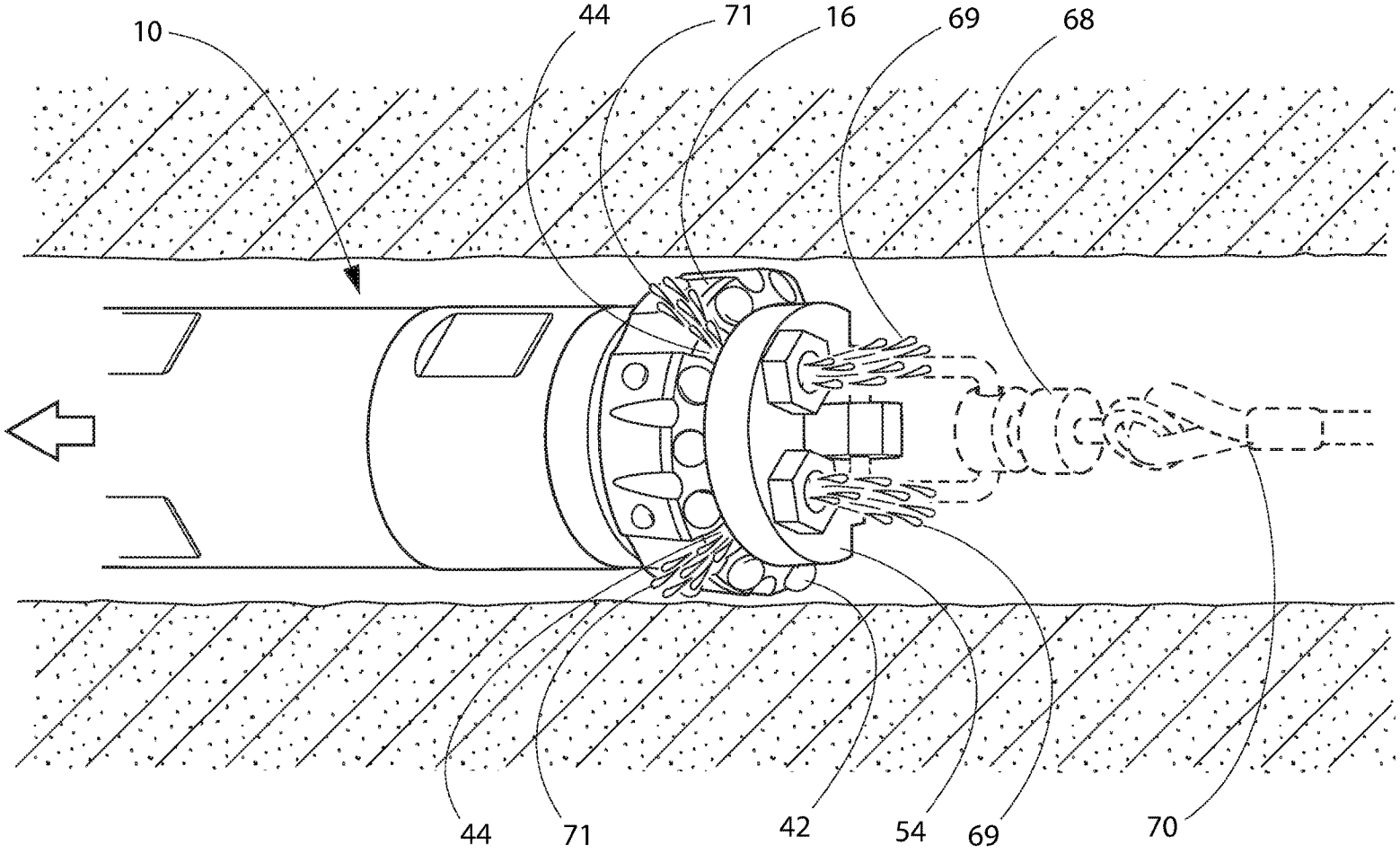
FIG. 12 is an opposite side view of the exemplary slant bit DTH hammer and product engagement member depicted in the FIG. 11 illustration.

FIGS. 11-12 depict leading end 10 of FIG. 1 retrofitted with product engagement member 54 for pulling product 70 through the previously completed pilot-channel. FIG. 11 illustrates the exemplary slant bit DTH hammer 12 and product engagement member 54 of FIG. 8 as it is being retracted through a pilot-channel to pull a product 70. FIG. 12 is an opposite side view of the FIG. 11 illustration. The FIG. 11 and FIG. 12 illustrations will be described simultaneously.

As previously described, once at the exit point the leading end 10 of the percussion boring system may be engaged to product engagement member 54. Next, product 70 may be engaged to product coupling portion 64 of product engagement member 54 as described above. Because the drill string of the percussion boring system remains in the pilot-channel after the pilot-channel portion of the percussion boring process, the percussion boring system may be simply pulled back through the previously completed pilot-channel as is understood by one having ordinary skill in the art. Consequently, attached product 70 is also pulled back through the pilot-channel. Notably, it is an advantage of the solutions that the drill bit 16 does not have to be replaced with a back reaming device in order for the product 70 to be pulled back through the bore. By modifying the drill bit 16 with the product engagement member 54, the drill bit 16 may be used to back ream the pilot bore and pull the product 70.

As can be seen in the FIGS. 11-12, because the drill string of the percussion boring system is being retracted back through the previously bored channel, and because the drill string is engaged with leading end 10 and because chuck 18 of leading end 10 is configured to hold bit 16, bit 16 is fully extended within chuck 18 during the product pulling stage of the percussion boring process. Similarly, because bit 16 is engaged with product engagement member 54 and because product engagement member 54 is engaged with product 70, leading end 10 pulls product 70 during the product pulling stage of the percussion boring process.

During the product pulling stage of the percussion boring process, fluid conduit 45 of bit 16 may guide pressurized drilling fluid from hydraulic motor 20 to exhaust ports 44 of bit 16 so that the pressurized fluid is expelled through fluid restriction portions 58 during the product pulling stage of the percussion boring process. Notably, because product engagement member 54 is engaged to leading end 10, and because product engagement member 54 covers exhaust ports 44 of bit 16, and because at least one fluid restriction portion 58 of product engagement member 54 extends into exhaust port 44 and because the surface contours of head 41 of bit 16 and the surface contours of product engagement member 54 are configured to channel this expelled pressurized fluid, product engagement member 54 may divert, substantially rearward from head 41, at least a portion of the expelled fluid stream (depicted as element 71). This may result in the removal of debris that could inhibit the efficient and effective pulling of product 70. Moreover, this may result in the removal of debris, via circulation of drilling fluid at any points of resistance between leading end 10 and the pilot-channel wall that may inhibit the efficient and effective pulling of product 70 as leading end 10 is pulled backwards. Moreover, this may result in additional erosion of the substrate, via the redirected pressurized drilling fluid, along the pilot-channel walls.

Additionally, because the fluid restriction portion 58 may be a bolt or pin configured to extend into the exhaust port 44 of bit 16, and because groove 63 and fluid channel 66 of the fluid restriction portion 58 provide a fluid pressure escape channel when the exhaust port 44 is partially blocked by product engagement member 54, the fluid restriction portion 58 may guide and expel at least a portion of the pressurized drilling fluid (depicted as element 69) substantially forward of head 41 of bit 16 relative to hydraulic motor 20. Similar to the diversion of the pressurized fluid described above, this may result in the removal of debris that is inhibiting the efficient and effective pulling of product 70. Moreover, this may result in the removal of debris, via circulation of drilling fluid at any points of resistance between product 70 and the pilot-channel wall, that may inhibit the efficient and effective pulling of product 70 as leading end 10 is pulled backwards.

It is further envisioned that embodiments of head 41 may be additionally configured to mechanically compliment the erosion caused by the redirected pressurized drilling fluid. For example, head 41 may comprise carbide teeth (depicted as element 42) situated at any point of engagement between head 41 and the walls of the pilot-channel during the product pulling stage of the percussion boring process. With this additional back reaming function, lead end 10 may be additionally configured to increase the cross-sectional area of the pilot-channel throughout its length and, in certain circumstances, further condition the walls of the pilot-channel for structural stability and/or reception of product 70.

While an exemplary embodiment of a drill bit assembly for a percussion boring system has been described in detail herein, it is to be understood that the inventive concepts may be otherwise variously embodied and employed. The appended claims are intended to be construed to include such variations except insofar as limited by the prior art. Possible variations, as described throughout this disclosure, are not to be regarded as a departure from the spirit and scope of the invention. All such possible variations, as would be obvious to one skilled in the art, are intended to be included within the scope of the preceding disclosure and the following claims.

It is understood that any variations of the features of the system and method described in the description section falls within the scope of the invention. There can be many embodiments of this invention as witnessed in some of the figures, and the discussions of them. Not all embodiments of a drill bit assembly for a percussion boring system that would fall within the scope of the claims are necessarily represented here.

In the description and claims of the present application, each of the verbs, "comprise", "include" and "have", and conjugates thereof, are used to indicate that the object or objects of the verb are not necessarily a complete listing of members, components, elements, or parts of the subject or subjects of the verb.

The various embodiments have been described using detailed descriptions of the embodiments, as well as features, aspects, etc. thereof. The various embodiments are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described, and embodiments of the present invention comprising different combinations of features as noted in the described embodiments, will occur to persons with ordinary skill in the art.

It will be appreciated by persons with ordinary skill in the art that the present invention is not limited by what has been particularly shown and described herein above. Rather the scope of the invention is defined by the claims that follow.

What is claimed is:

1. A percussion drilling drill bit comprising:

a head having a top engaging face and a bottom;

a shank with a first end attached to the bottom of the head and extending longitudinally away from the bottom and a second end distal from the first end and defining an anvil and the shank defining a fluid conduit extending from the second end to the first end;

at least one forward opening exhaust port defined within the head, the at least one forward opening exhaust port being in fluid communication with the fluid conduit, the at least one forward opening exhaust port configured to expel a fluid stream in a forward direction relative to the top engaging face of the head;

an attachment interface defined on the top engaging face of the head, the attachment interface configured to receive an attachment a pulling attachment configured to be coupled to the head at the attachment interface and comprising a coupling portion that is configured to freely rotate independent from the head when the pulling attachment is coupled to the head, whereby a material can be attached to the coupling portion and pulled through a pilot-channel created by the percussion drilling bit without having to remove the percussion drilling bit; and wherein the pulling attachment is configured to divert at least a portion of the expelled fluid stream from the at least one forward opening exhaust port in a direction towards substantially away from the forward direction.

2. The percussion drilling bit of claim 1, wherein the pulling attachment comprises an engagement member that is coupled to the engaging face of the head and the coupling portion.

3. The percussion drilling bit of claim 2, wherein the engagement member is coupled to the engaging face of the head by a pin that is inserted through the engagement member and into the at least one forward opening exhaust port.

4. The percussion drilling bit of claim 3, wherein the pin diverts at least a portion of the expelled fluid stream.

5. The percussion drilling bit of claim 2, wherein the engagement member is coupled to the engaging face of the head by a bolt that is inserted through the engagement member and into the at least one forward opening exhaust port.

6. The percussion drilling bit of claim 5, wherein the bolt diverts at least a portion of the expelled fluid stream.

7. The percussion drilling bit of claim 2, wherein the engagement member is coupled to the engaging face of the head by a threaded bolt that is inserted through the engagement member and into the at least one forward opening exhaust port, and wherein the at least one forward opening exhaust port includes a threaded receptor for the threaded bolt.

8. The percussion drilling bit of claim 7, wherein the threaded bolt diverts at least a portion of the expelled fluid stream.

9. The percussion drilling bit of claim 1, wherein the pulling attachment comprises an engagement member that is coupled to the engaging face of the head and the engagement member covers a portion of the engaging face of the head.

10. A method for pulling a material through a pilot-channel created by a percussion drill bit, the method comprising the actions of:

attaching the percussion drill bit to a percussion drilling system, the percussion drill bit comprising:

a head having a top engaging face and a bottom;

a shank with a first end attached to the bottom of the head and extending longitudinally away from the bottom and a second end distal from the first end and defining an anvil and the shank defining a fluid conduit extending from the second end to the first end;

at least one forward opening exhaust port defined within the head, the at least one forward opening exhaust port being in fluid communication with the fluid conduit, the at least one forward opening exhaust port configured to expel a fluid stream in a forward direction relative to the top engaging face of the head;

an attachment interface defined on the top engaging face of the head, the attachment interface configured to receive an attachment;

boring the pilot-channel resulting in an opening at a distal end, wherein the percussion drill bit extends out of the opening;

attaching a pulling attachment to the head at the attachment interface, wherein the pulling attachment comprises a coupling portion that is configured to freely rotate independent from the head when the pulling attachment is coupled to the head;

attaching a material to the coupling portion; and pulling the material through the pilot channel; and further comprising the action of diverting at least a portion of the expelled fluid stream from the at least one forward opening exhaust port in a direction towards substantially away from the forward direction by attaching the pulling attachment to the head.

11. The method of claim 10, wherein the pulling attachment includes an engagement member and the action of attaching the pulling attachment to the head comprises coupling the engaging face of the head and the coupling portion.

12. The method of claim 11, wherein the action of attaching the pulling attachment to the head comprises inserting a pin through the engagement member and into the at least one forward opening exhaust port.

13. The method of claim 12, wherein the pin diverts at least a portion of the expelled fluid stream.

14. The method of claim 11, wherein the action of attaching the pulling attachment to the head comprises inserting a bolt through the engagement member and into the at least one forward opening exhaust port.

15. The method of claim 14, wherein the bolt diverts at least a portion of the expelled fluid stream.

16. The method of claim 11, wherein the action of attaching the pulling attachment to the head comprises inserting a threaded bolt that is inserted through the engagement member and into the at least one forward opening exhaust port, and wherein the at least one forward opening exhaust port includes a threaded receptor for the threaded bolt.

17. The method of claim 16, wherein the threaded bolt diverts at least a portion of the expelled fluid stream.

* * * * *